United States Patent [19]

Smathers et al.

[11] Patent Number: 4,463,518

[45] Date of Patent: Aug. 7, 1984

[54] COMBINATION VEHICLE AND TOP TOY

[75] Inventors: Robert E. Smathers, Los Angeles, Calif.; John R. Wildman, North Riverside; Burton C. Meyer, Downers Grove, both of Ill.

[73] Assignee: Marvin Glass & Associates, Chicago, Ill.

[21] Appl. No.: 433,228

[22] Filed: Oct. 7, 1982

[51] Int. Cl.[3] ..... A63H 29/20; A63H 1/00

[52] U.S. Cl. ..... 446/237; 446/435; 446/462

[58] Field of Search ..... 46/202, 204, 209, 201, 46/65, 50, 67, 72, 71, 269

[56] References Cited

U.S. PATENT DOCUMENTS 1,527,205 2/1925 MacPherson ..... 46/64 X
3,628,285 12/1971 Murakami ..... 46/269

FOREIGN PATENT DOCUMENTS 736318 11/1932 France ..... 46/67

*Primary Examiner*—Mickey Yu
*Attorney, Agent, or Firm*—John S. Pacocha

[57] ABSTRACT

A top is releaseably carried by a vehicle for rotation about an axis upon an external force effecting linear movement of the vehicle and rotation of a drivingly related surface engaging wheel. If the wheel is suddenly stopped the momentum of the top will overcome the force retaining it and the spinning top will be ejected from the vehicle. The vehicle has a track to facilitate insertion and ejection of the top.

8 Claims, 6 Drawing Figures

COMBINATION VEHICLE AND TOP TOY

BACKGROUND OF THE INVENTION

1. Field of the Invention

This invention relates generally to mechanical toy devices.

2. Background Art

The use of the rotation of ground engaging wheels on vehicles to impart motion to other components is well known. Similarly, spinning tops have long been used as toys. While such toys have separately provided entertainment value, it would be desirable to provide a combination which would enhance the enjoyment aspect of each of the components of the combination. Moreover, imparting the energy required to spin the top is often not an enjoyable task.

SUMMARY OF THE INVENTION

The present invention is concerned with providing a toy that provides an entertaining vehicle means for building up momentum in a top for spinning and also enhances play with the vehicle. These and other objects and advantages are achieved by having the top positioned for rotation about an axis while releasably carried by a vehicle having a ground engaging wheel mounted for rotation when the vehicle is moved along a surface and which is drivingly connected to rotate and build up momentum in the top. Abruptly stopping the rotation of the wheel results in ejection of the spinning top from the vehicle. Track means are provided on the vehicle for insertion and ejection of the top.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
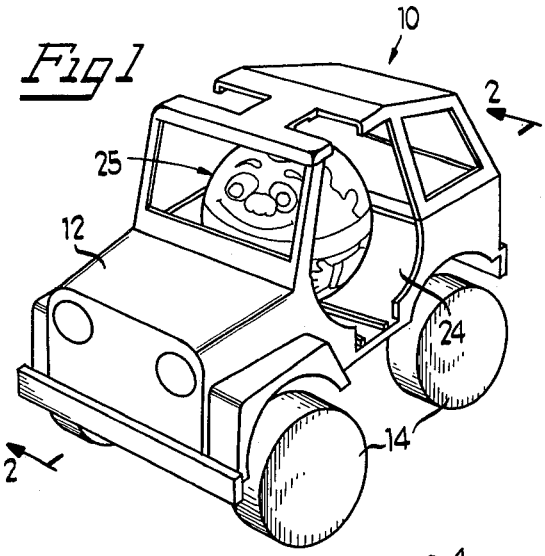
FIG. 1 is a perspective view of one embodiment of the present invention.

Referring now to the drawing in which like reference characters are used for like parts through the several views, there is shown in FIG. 1 a toy wheeled vehicle 10 having a body 12 and surface engaging wheels 14. Each of a pair of the wheels 14 is mounted on an end of the front axle 16 and each of another pair of the wheels 14 is mounted on an end of rear axle 18. Downwardly extending tabs 20 are provided to mount each of the axle-wheel combinations for rotation. The tabs 20 may be secured to, or integrally formed with, base or bottom piece 22 that is separable from the body 12. Use of a separable base 22 may permit combination of a single base and axle-wheel assembly with different body styles to facilitate producing a line of related toys. Certain body styles, such as in FIG. 1, will be provided with an opening 24 to accommodate top 25.

As shown in the drawings, the top 25 is positioned within the body 12 and personified as the driver or operator of the vehicle. Top 25 is releasably carried by the vehicle 10 and is positioned for rotation in the vehicle 10 conveniently at about the midpoint. However, as will be appreciated by those skilled in the art, the exact positioning of the top within the vehicle is not critical and may be varied. In fact, modifications of this invention may be made to provide for the vehicle to carry a plurality of releasable spinning tops.

Although the shape of the top may vary, it has been found convenient both from a manufacturing and aesthetic standpoint to use hollow sphere 26. The top 25 has an upper boss 27 carrying an upper end point 28 and an opposed lower boss 29 carrying a lower end point 30 which may be integrally formed as part of the sphere 26. The points 28 and 30 define the ends of the axis about which the top rotates. Each of the points 28 and 30 abut a portion of the vehicle body 12 such that friction retains the top 25 in a rotatable position. As shown in the preferred embodiment the top is positioned for rotation on a substantially vertical axis so that the upper point 28 engages the body 12 and the lower end point 30 engages the base member 22. However, it will again be appreciated by those skilled in the art that the top may be positioned along an axis other than vertical, as for example a horizontal axis. Top 25 includes a gear 32 for drivingly connecting the top to at least one of the ground wheels 14. Gear 32 is coaxial with the axis of rotation defined by points 28 and 30 and mounted above the lower point 30.

Vehicle 10 has a gear train 35 which drivingly connects the ground wheels 14 on the front axle 16 and the top 25. Gear train 35 includes a crown gear 36 coaxially secured to front axle 16 for rotation therewith. The body 12 and base 22 bear a coaxial combination pinion 38 and large gear 39 on a substantially vertical stem 40. Crown gear 36 engages pinion 38 mounted above it. The lower portion of the stem 40 may be journaled for rotation in the base 22. Because of the body style desired in a particular embodiment it may be necessary to provide an internal supporting member 44 such as best shown in FIG. 2 to journal the upper portion of the shaft 40.

Figure 2:
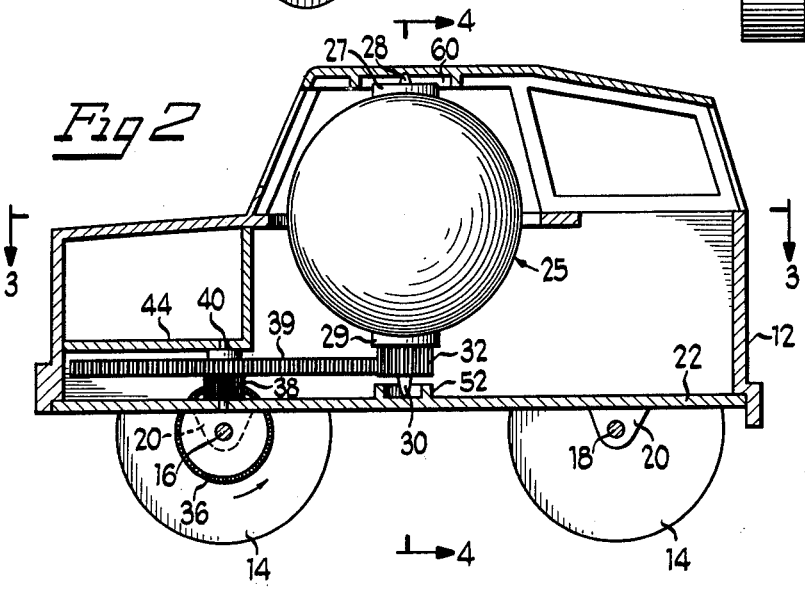
FIG. 2 is an enlarged cross-sectional view taken along the line 2—2 of FIG. 1.
Figure 3:
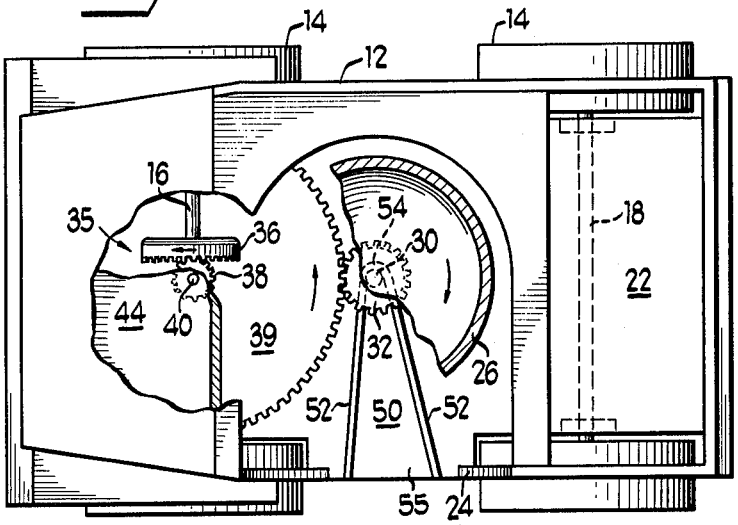
FIG. 3 is an enlarged partially cut-away sectional top view taken substantially along the line 3—3 of FIG. 2.

As shown in FIGS. 2 and 3, forward linear motion of the vehicle 10 along a surface by the application of an external force such as pushing by a child causes counterclockwise rotation of the wheels 14 and the crown gear 36. The engagement of the upper portion of the crown gear 36 with pinion 38 causes a like counterclockwise rotation of the pinion and the coaxial large gear. The ratio of the gears 36, 38, and 39 plus the gear 32 that is part of the top is such that the top is driven at a higher velocity than the wheel 14.

The top 25 functions as a flywheel when the external force is removed and the wheels 14 and associated gear train 35 are permitted to continue rotating. In such a situation the kinetic energy of the top is transferred through the gear train 35 to drive the wheels and continue the linear motion of the vehicle. However, if the rotation of the wheels and gear train is abruptly stopped such as would result from the crashing of the vehicle into a stationary object, the momentum of the top 25 will be unable to overcome the inertia of the wheels 14 and gear train 35. In that situation the momentum of the top 25 will disengage gear 32 from gear 39 and overcome the frictional force restricting the linear movement of the points 28 and 30, and the spinning top will eject itself from the vehicle body through the opening 24. The ejected top should then continue to spin on the surface onto which it has been thrown upon ejection from the vehicle.

Figure 4:
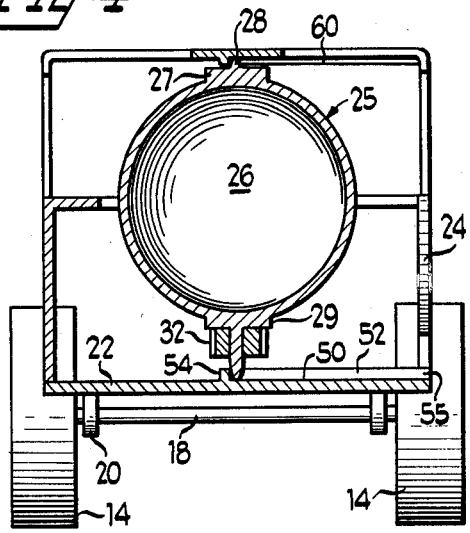
FIG. 4 is an enlarged cross-sectional view taken substantially along line 4—4 of FIG. 2.

For insertion of the top 25 into position on the vehicle body 12 and to provide direction for the ejected top, a track or guide means 50 is provided. In the preferred embodiment, similar track means are provided for both the upper point 28 and the lower point 30. The track 50 is formed of raised ribs 52 which may be an integral part or secured to the base 22. The track 50 is generally elongated in the dimension along which the top is to be inserted and ejected and the track has a closed end 54 adjacent the point 30 when the top is in the retained position and an opposed open end 55 adjacent the edge of the base 22 or part of the body 12 bearing the track. As shown in FIGS. 2–4, the vehicle body 12 is provided with a track 60 similar to the track 50 for the other end point 28. Both of the tracks 50 and 60 are provided with an increasing taper that opens from the closed end to the open end. The taper facilitates insertion of the top into position. Depending on the body style of the vehicle and the size and shape of the opening 24 the specific shape of the track 50 or the track 60 may have to be modified so that the spinning top does not hit the sides of the opening when it is ejected.

Figure 5:
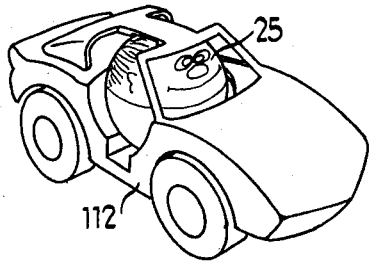
FIG. 5 is a perspective view of another embodiment of the present invention.
Figure 6:
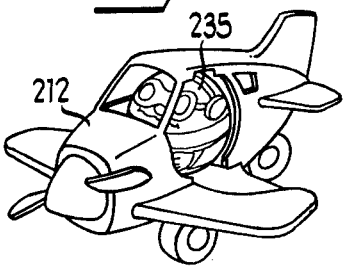
FIG. 6 is a perspective view of yet another embodiment of the present invention.

In the alternative embodiment shown in FIG. 5 the vehicle has been modified to represent a sports car 112. As indicated in FIG. 6 other vehicles such as an airplane 212 may be employed. As is also indicated in FIG. 6 modifications may be made to the visual design of the top as has been done with top 235 to make it more aesthetically compatible with the vehicle design.

While there have been illustrated and described particular embodiments of the present invention, it will be apparent that various changes and modifications will occur to those skilled in the art. It is intended in the following claims to cover all such changes and modifications as fall within the true spirit and scope of the present ivnetion.

What is claimed as new and desired to be secured by Letters Patent is:

1. A combination vehicle and top toy comprising:

a vehicle having a surface engaging wheel mounted for rotation during linear movement of the vehicle along a surface;

a top including an axis of rotation;

the top being releasably carried by the vehicle in a rotatable position for rotation about the axis;

disengageable drive means drivingly connecting the surface engaging wheel and the top so that linear movement of the vehicle along a surface by an external force rotates the top and imparts momentum; and means for retaining the top in the rotatable position during continued rotation of the wheel and permitting the rotating top to disengage itself from the drive means and eject itself from the vehicle when the rotating wheel drive means are abruptly stopped.

2. The combination vehicle and top toy of claim 1 in which:

the top has opposed end points that define the axis of rotation; and portions of the vehicle frictionally engage the points to retain the top in the rotatable position during rotation of the wheel.

3. The combination vehicle and top toy of claim 1 in which:

the drive means includes a coaxial pinion and large gear driven by the wheel and a gear on the top coaxial with the axis of rotation; and the large gear engages the gear on the top when the top is positioned for rotation.

4. The combination vehicle and top toy of claim 2 in which means defining a track on the vehicle are provided for one of the end points.

5. The combination vehicle and top toy of claim 4 in which the track means define an elongated track having a closed end and an open end.

6. The combination vehicle and top toy of claim 5 in which:

the top is positioned for rotation within the vehicle;

an opening is provided in the vehicle for insertion and ejection of the top; and the open end of the track coincides with the opening in the vehicle.

7. The combination vehicle and top toy of claim 4 in which the track increases in width from the closed end to the open end.

8. The combination vehicle and top toy of claim 4 in which another track means is provided for the other end point.

* * * * *